US006145567A

United States Patent [19]

Henley, Jr.

[11] Patent Number: 6,145,567

[45] Date of Patent: Nov. 14, 2000

[54] BLIND VALANCE ASSEMBLY AND METHOD

[76] Inventor: E. Patrick Henley, Jr., 611 Bellemeade St., Greensboro, N.C. 27401

[21] Appl. No.: 09/354,862

[22] Filed: Jul. 29, 1999

[51] Int. Cl.[7] ..... E06B 9/00

[52] U.S. Cl. ..... 160/38; 160/349.1

[58] Field of Search ..... 160/38, 39, 19, 160/405, 349.1, 349.2, 348

[56] References Cited

U.S. PATENT DOCUMENTS

| | | | |
|---|---|---|---|
| 2,542,714 | 2/1951 | Schwartz | 160/38 |
| 4,384,605 | 5/1983 | Schaeffer et al. | 160/38 |
| 4,662,421 | 5/1987 | Basamadji et al. | 160/38 |
| 5,042,548 | 8/1991 | Attal | 160/38 |
| 5,520,234 | 5/1996 | Simmons | 160/38 |
| 5,597,025 | 1/1997 | Forkner | 160/38 |
| 5,896,909 | 4/1999 | Sartini | 160/349 |

*Primary Examiner*—David M. Purol

[57] ABSTRACT

A valance assembly is provided which is both functional and which will add to the attractiveness to a particular window or door. The valance assembly includes a valance and decorative end brackets at each end of the valance. In an alternate embodiment, longitudinal members are affixed to the valance brackets to assist in blocking light for blinds which are of the "outside" mounted.

5 Claims, 5 Drawing Sheets

BLIND VALANCE ASSEMBLY AND METHOD

FIELD OF THE INVENTION

The invention herein pertains to valances for windows and doors and particularly to decorative valance brackets as used therein.

DESCRIPTION OF THE PRIOR ART AND OBJECTIVES OF THE INVENTION

Many types of window treatments are known and used within the decorating industry to enhance the usefulness and appearance of building windows and doors. Pivotal blinds are commonly used of both the "inside" and "outside" type mountings. "Inside" blind configurations are blinds which are mounted within a window wall cavity and are generally mounted flushly with the room interior wall. Outside mounted blinds are blinds for example, mounted directly on a door or window surface and extend into the room. At the top of conventional blinds, whether of the horizontal or vertical type, is trough or gutter which contains the operating mechanism for the blind. It has been a practice for many years in the industry to attach a valance which consists of a planar strip of plastic, wood, fabric or the like along the front of the trough to make the trough more ornamental and pleasing to the eye. On outside mounted blinds, the valance may cover the front of the trough, and at each end return to the wall where it is generally attached. Valances and valance assemblies are decorative enhancements which are used to add to the attractiveness and appearance of windows or doors and conceal the mechanical and operational features of for example a window blind.

While pivotal blinds generally do a satisfactory job of eliminating window light entry when they are closed, on the outside type blind mounting, light along the edges of the blinds can be of concern, particularly for decorators that are attempting to more completely darken a room during daylight hours, without the use of window draperies and curtains.

In addition, valances as are commonly used are somewhat lacking in their attractiveness and functionality, requiring decorators to often use full length curtains to provide a more attractive window appearance.

Thus with the known problems and disadvantages associated with prior art window treatments and conventional valances, the present invention was conceived and one of its objectives is to provide a valance assembly which adds aesthetically to the appearance of conventional blind valances.

It is yet another objective of the present invention to provide a valance assembly and method which can be easily adapted to either "outside" or "inside" blind mountings.

It is a further objective of the present invention to provide a valance assembly which can be easily mounted and thereafter quickly changed during redecoration.

It is still another objective of the present invention to provide a valance assembly which can be varied in style and appearance.

It is also an objective of the present invention to provide a valance assembly for outside mounted blinds which includes longitudinal members to assist in blocking room light entry.

Various other objectives and advantages of the present invention will become apparent to those skilled in the art as a more detailed description is set forth below.

SUMMARY OF THE INVENTION

The invention herein pertains to valance assemblies which are affixed to conventional window and door blinds, normally of the pivotal type. The valance assembly of the present invention in its preferred form consists of a valance bracket pair which affix to the blind trough proximate the window top. The valance brackets form right angles and extend downwardly below the bottom of the valance. The valance brackets can be attached to the trough with standard valance clips and can include decorative knobs or other features for supporting fabric swags or the like.

In an alternative embodiment of the invention for use in outside mounted blinds, longitudinal members extend from the valance brackets perpendicular to the valance, along the entire window or door length. These longitudinal members help in preventing light entry into the room at the sides of the window or door at the ends of the blind slats.

The preferred method as described herein provides mounting the valance assembly with brackets and attaching the longitudinal light control members to the window or door as needed.

DETAILED DESCRIPTION OF THE PREFERRED EMBODIMENT AND OPERATION OF THE INVENTION

Figure 1:
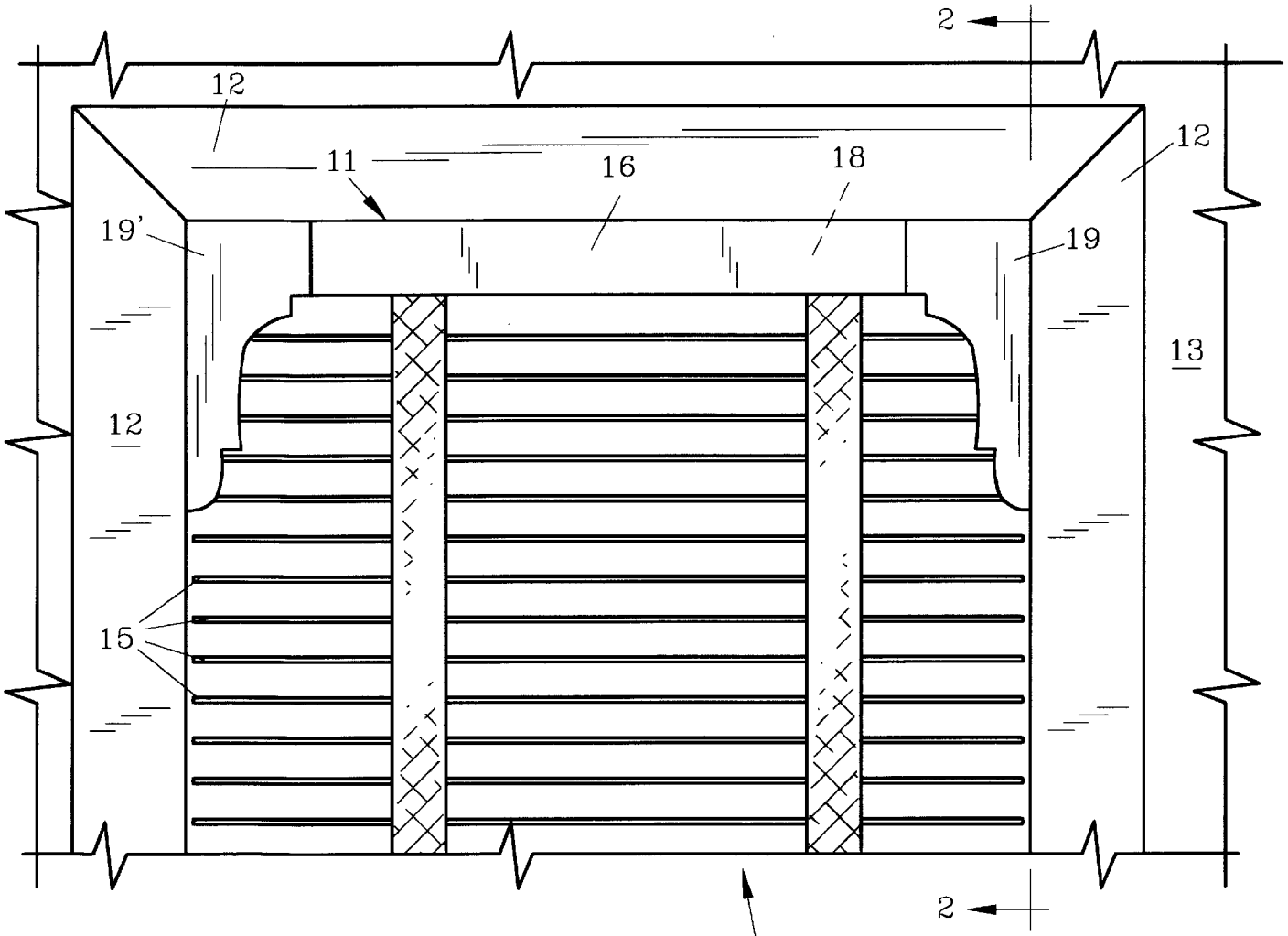
FIG. 1 demonstrates a fragmented front interior elevational view of a window with the preferred form of the valance assembly in place.
Figure 2:
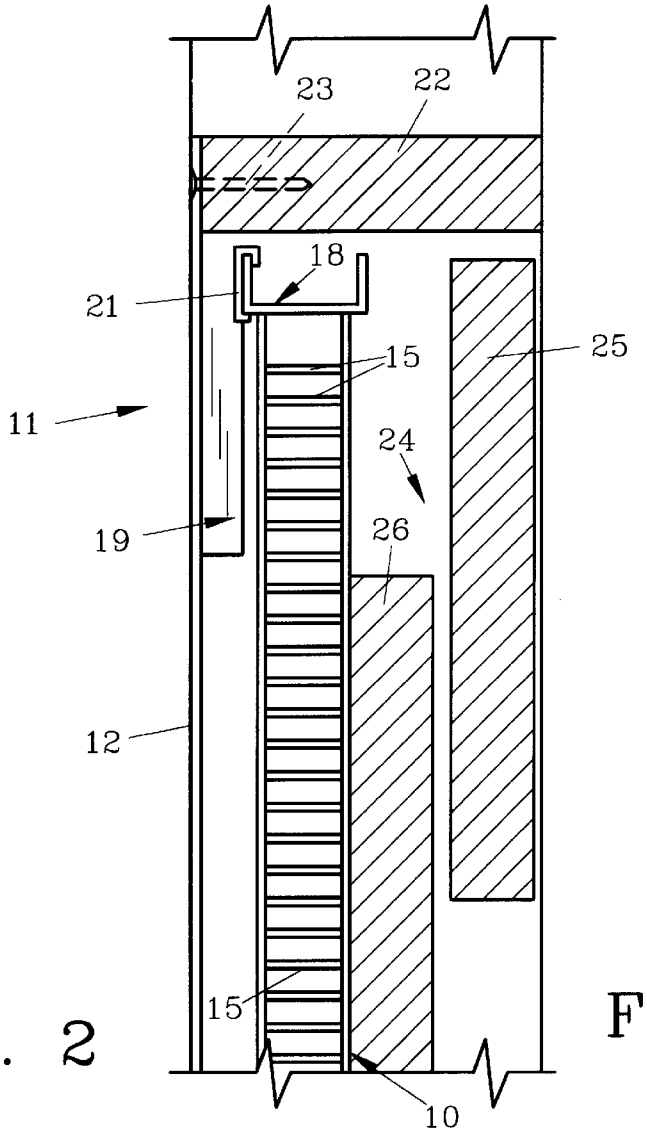
FIG. 2 illustrates a side view along lines 2—2 of FIG. 1.

For a better understanding of the invention and its operation, turning now to the drawings, FIG. 1 demonstrates a typical window as seen from the building interior with blinds 10 mounted in "inside" style and having trough 18 (FIG. 2) as is conventional. Preferred valance assembly 11 includes valance 16 and valance brackets 19, 19' affixed to trough 18 such as by flexible, plastic clips 21 as are standard in the industry. Preferred valance brackets 19, 19' are shown abutting opposite ends of valance 16 and are affixed to blind trough 18 also by clips 21, although other means for attaching may be utilized such as conventional fasteners, staples, screws, bolts, Velcro, adhesives or the like. As further shown in FIG. 1, valance brackets 19, 19' are substantially flushly mounted with valance 16 and with interior window molding 12. Window molding 12 is attached to window header 22 by fastener 23 as seen in FIG. 2. Blinds 10 are conventional, horizontal pivotal blinds and the operating cords and mechanism (not shown) are contained within trough 18. Slats 15 are standard wooden, plastic or metal slats as have long been used in the industry. First and second valance brackets 19, 19' provide an attractive right angle shape and aesthetic appearance to the window through various styles and designs may be utilized. While valance assembly 11 is shown as three separate elements in its preferred form, it could be manufactured as a unitary element, such as by sawing, carving, stamping or molding.

Figure 3:
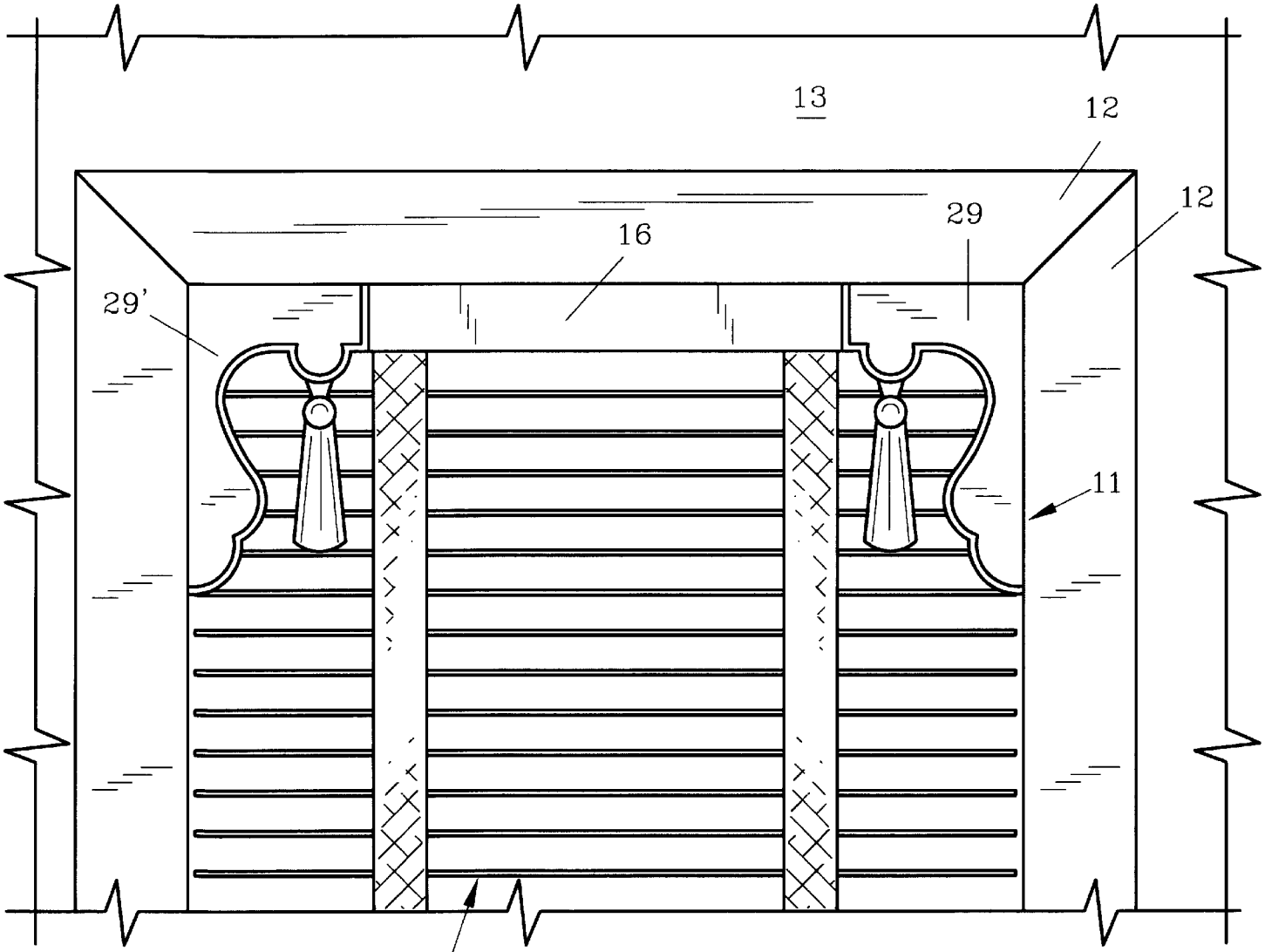
FIG. 3 shows a window as in FIG. 1 but with a different valance assembly in place.

In FIG. 2, window 24 is a double-hung window having upper sash 25 and lower sash 26. Slats 15 are seen in an open position in both FIGS. 1 and 2. In FIG. 3, blind 10 is also shown with open slats and with planar valance 16 affixed to trough 18 (not shown in FIG. 3) as usual. At each end of valance 16, first and second valance brackets 29, 29' are positioned having an alternate design to that shown in FIG. 1. Brackets 29, 29' are contiguous to valance 16 and are substantially flushly mounted with window molding 12 to provide an appearance which is both aesthetically pleasing and which prevents light from entering the room at the upper corners of blind 10.

Figure 5:
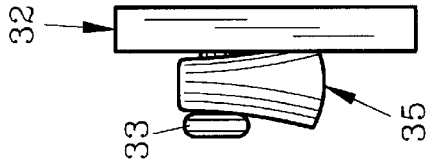
FIG. 5 features a side elevational view along lines 5—5 of FIG. 4.
Figure 4:
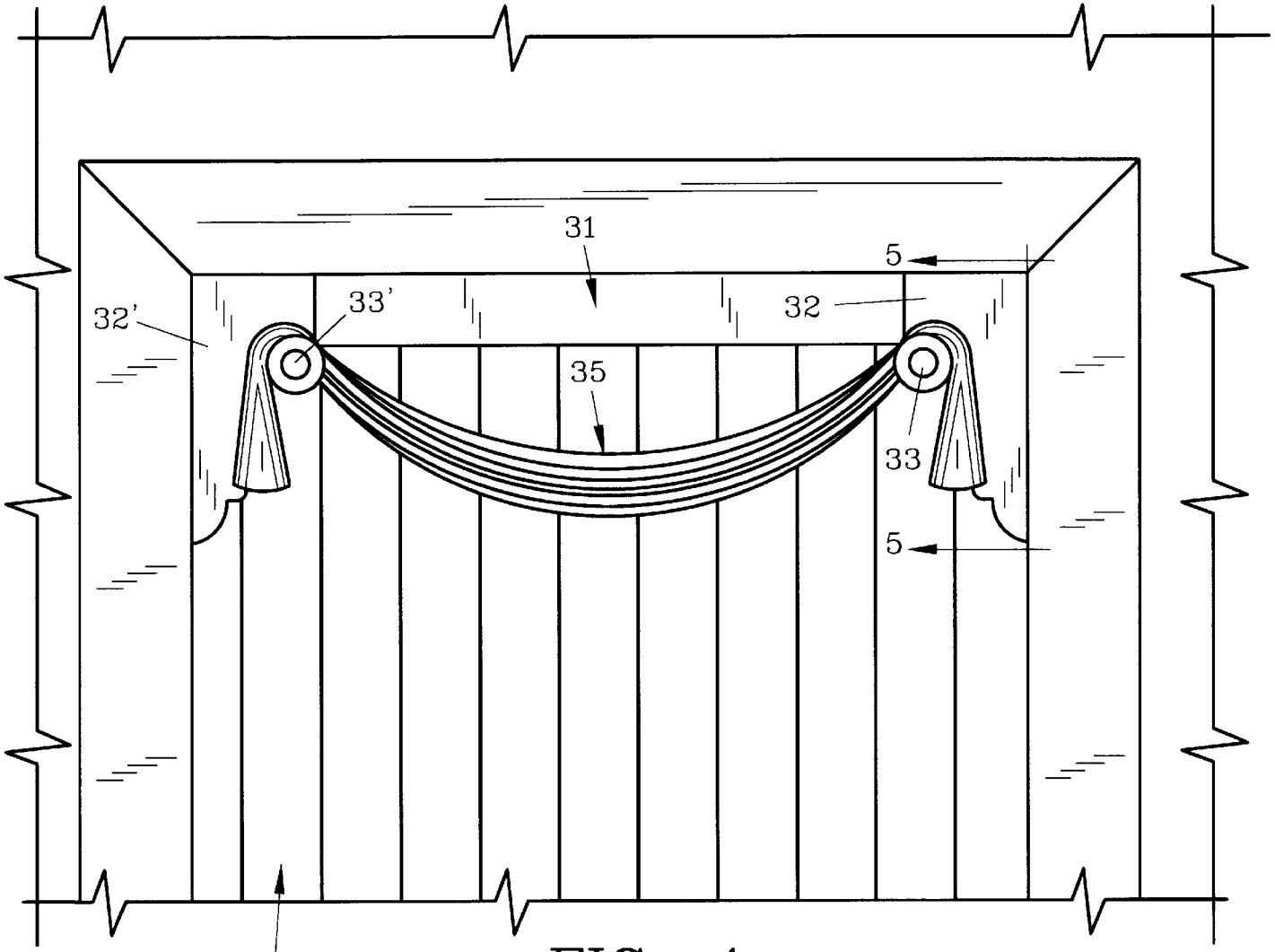
FIG. 4 depicts another style of valance assembly of the invention.

In FIG. 4, yet another style valance bracket is seen with valance assembly 31 whereby first and second valance brackets 32, 32' include knobs 33, 33' respectively which extend outwardly from valance brackets 32, 32'. Blind 30 is of the standard "vertical" slat configuration. Knobs 33, 33' support swag 35 draped thereon, as also seen in FIG. 5. Brackets 32, 32' are formed from wood, metal, plastic or other suitable materials to match valance 16 or otherwise as may be desired. Valance 16 and brackets 32, 32' are generally of a relatively thin material, for example 5–10 millimeters in thickness but could be more or less as for a specific window design or for a window having unusual dimensions.

Figure 7:
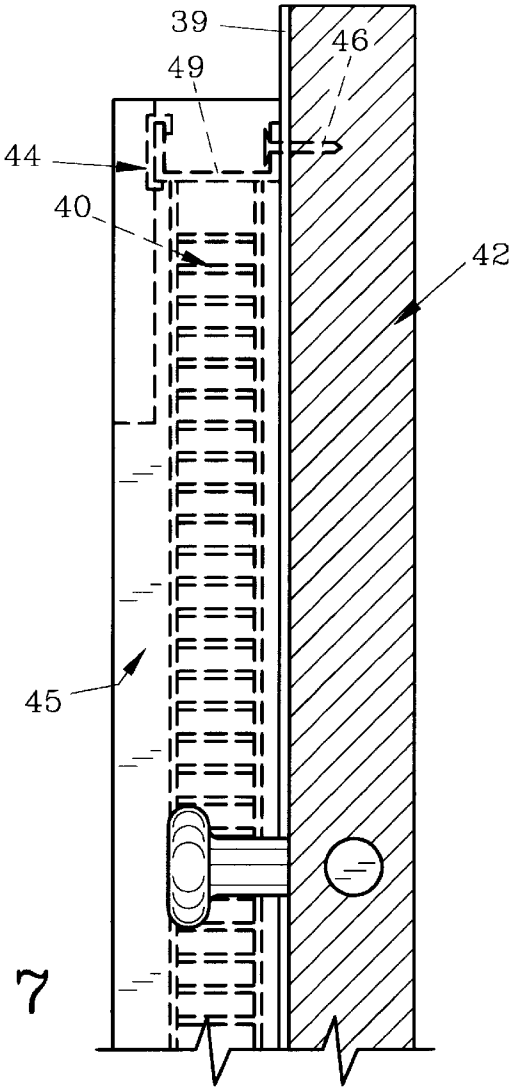
FIG. 7 provides a fragmented side elevational view along lines 7—7 of FIG. 6.
Figure 6:
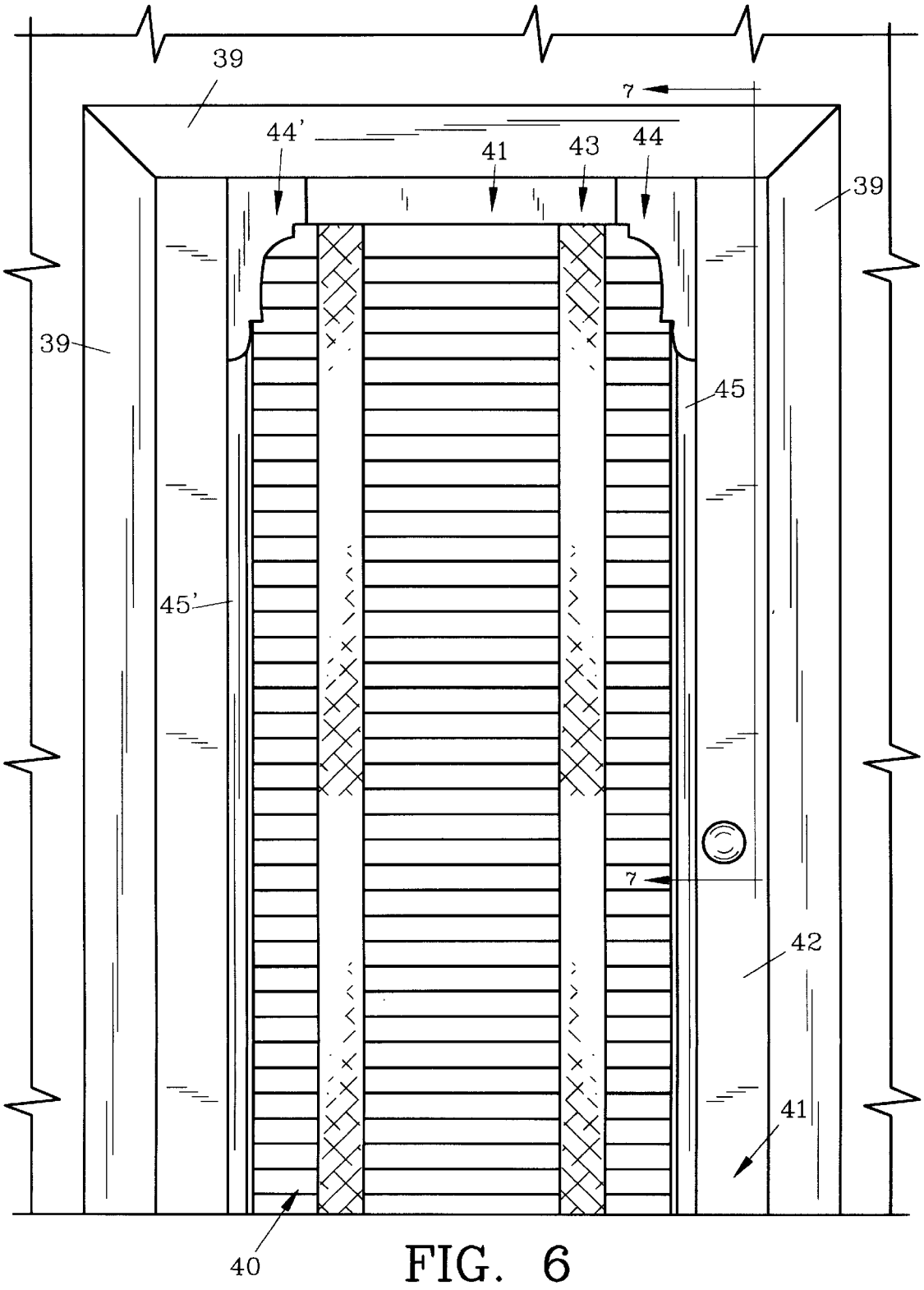
FIG. 6 pictures a typical patio door with an outside blind mounting and a valance assembly of the present invention thereon.

Oftentimes bedrooms, dens and the like include patio or other type doors having transparent panes. As seen in FIG. 7, blinds 40 are of the "outside" mounted type attached to the surface of door 42 so as to protrude from door 42 inwardly into the room. In FIG. 6, door 42 is surrounded by jamb molding 39 with blind trough 49 (containing operating components not shown) affixed thereto such as by threaded member 46. For "outside" hung blinds, valance assembly 41 and longitudinal members 45, 45' are attached to door 42 by screws, adhesive or other fasteners. Longitudinal members 45, 45' may be formed from wood, metal or other suitable materials and are affixed at their upper ends to valance brackets 44, 44'. First and second longitudinal members 45, 45' add an advantage to valance assembly 41 in that they help prevent light entering the room between blinds 40 and door 42. This feature is especially beneficial in bedrooms and other areas that are desired darkened during daylight hours.

The illustrations and examples provided herein are for explanatory purposes and are not intended to limit the scope of the appended claims.

I claim:

1. A valance assembly comprising: a planar valance, a first valance bracket, a second valance bracket, said first and said second valance brackets contiguous to said valance and coplanar therewith, said first and said second valance brackets mounted on opposite sides of said valance, a first knob, said first knob attached to said first bracket, a second knob, said second knob attached to said second bracket, and said knobs each extending linearly directly outwardly from said bracket for supporting a swag.

2. The valance assembly as claimed in claim 1 wherein said first valance bracket extends downwardly from said valance.

3. The valance assembly of claim 1 wherein said first valance bracket comprises a right angle.

4. The valance assembly as claimed in claim 1 further comprising first and second longitudinal members, said first and second longitudinal member contiguous to said first and said second valance brackets respectively.

5. A method of affixing a valance assembly to a blind having an operation component trough, said method comprising the steps of:

a) affixing a planar valance to said trough;

b) affixing a first and a second valance bracket to said trough contiguous said valance on opposite sides of said valance; and c) affixing knobs to said first and said second valance brackets for supporting a swag.

* * * * *